United States Patent [19]

Gertz

[11] 4,143,462

[45] Mar. 13, 1979

[54] CHALK LINE DEVICE

[76] Inventor: Arthur R. Gertz, 512 E. Maple, Fairview, Okla. 73737

[21] Appl. No.: 841,683

[22] Filed: Oct. 13, 1977

[51] Int. Cl.[2] ..... B44D 3/38

[52] U.S. Cl. ..... 33/87; 33/27 C

[58] Field of Search ..... 33/27 C, 36, 37, 87, 33/138, 41 C

[56] References Cited

U.S. PATENT DOCUMENTS

| | | | |
|---|---|---|---|
| 491,715 | 2/1893 | Mondor | 33/138 |
| 747,497 | 12/1903 | Stanley | 33/87 |
| 874,588 | 12/1907 | Hays | 33/36 |
| 2,589,500 | 3/1952 | Landon et al. | 33/87 X |
| 3,191,308 | 6/1965 | Lindenau | 33/87 |
| 3,888,010 | 6/1975 | Hyde et al. | 33/87 |

*Primary Examiner*—Charles E. Phillips
*Attorney, Agent, or Firm*—William R. Laney

[57] ABSTRACT

A chalk line device for storing and dispensing a chalk line, and also functioning as a plumb bob and arc scribing instrumentality. The device includes a housing formed of a pair of cooperating side plates which define a chalk and reel-receiving chamber having openings at opposite ends thereof. A centrally mounted chalk line reel is rotatably mounted within the chamber between the end openings. An arc scribing disk is mounted at one end of the chamber to project partially through one of the end openings, and a chalk line is extended from the reel through the opening at the other end of the chamber.

11 Claims, 4 Drawing Figures

CHALK LINE DEVICE

BACKGROUND OF THE INVENTION

1. Field of the Invention

This invention relates to chalk line devices used for establishing a line between two points during construction work by the employment of a flexible string or line carrying chalk.

2. Brief Description of the Prior Art

A number of devices have heretofore been proposed for use by carpenters and in similar trades for the purpose of establishing an identifiable marked out line between two points. One of the most widely used of these devices is a chalk line device which includes a chalk-containing housing which also contains a reel upon which a flexible string or the like is reeled, and is paid out through a hole in one end of the chalk-containing housing. At its end outside the housing, the string will usually carry some type of ring or clip which will permit that end of the string to be secured in a fixed positon. The housing can then be drawn away from the outer end of the string, after it is fixed in place, to a second location to which it is desired to establish a marked line. As the housing is moved away from the anchored end of the chalk line, the line is paid out from the reel and in moving through the body of chalk dust carried within the housing, picks up a significant amount of chalk which adheres to the line. After the two points between which the line is to be established have been determined, and the housing then placed at one end and the free end of the string at the other, the string can be snapped to cause the chalk to be jarred therefrom and left in a line corresponding to the extension of the string between the two points.

Although the chalk line device, per se, is old in the art, in recent times several improvements on these very useful adjuncts to the carpenter's trade have been developed. Thus, in U.S. Pat. No. 2,589,500 to Linden et al., the housing which contains the chalk dust and the reel upon which the chalk line is stored is made in a shape or configuration which permits it to be used as a plumb bob. This can be accomplished by reeling out the chalk line carrying a loop or ring at its free end outside the housing to a point where the line can be suspended from an overhead location, and the housing permitted to swing pendulum fashion from such point of suspension. The lower end of the housing comes to rest over a point which is directly below, and in vertical alignment with, the anchored free end of the chalk line.

This form of the chalk and reel housing has been retained in a more recent type of chalk line device as shown in Landen U.S. Pat. No. 2,749,618. The Landen patent includes a quick opening and closing pivoted plate which is mounted through an opening at one side of the chalk box to permit the box to be quickly refilled with chalk dust at a time when the supply has become exhausted through use of the device.

In U.S. Pat. No. 3,126,637 to Short, a dual line chalk box is provided which contains a pair of reels disposed on opposite sides of a chamber containing the chalk dust, with the respective chalk lines carried on these reels being paid out through openings formed in opposite ends of the housing. By dividing the chamber in which the two reels are located into two separate chambers, two colors of chalk dust may be utilized so that the two chalk lines snapped at different places or for different purposes may be distinguished by the use of either one of the lines, according to the color of chalk dust carried thereby.

More recent improvements in chalk line devices are depicted in U.S. Pat. No. 3,438,595 to Brown et al. and U.S. Pat. No. 3,888,018 to Hyde et al.

GENERAL DESCRIPTION OF THE PRESENT INVENTION

The present invention comprises a chalk line device for storing and dispensing a chalk line, and which is also functional as a plumb bob and as an arc scribing instrumentality. Both of the latter functions are extremely valuable in carpentry and various construction trades, and impart flexibility and advantage to the use of the chalk line device of the present invention as compared to those which have heretofore been proposed.

Broadly described, the chalk line device of the invention includes a pair of cooperating side plates which fit together to form a hollow housing. On the interior of the housing, a chalk dust and reel-receiving chamber is disposed and there are openings in the housing located at opposite ends of this chamber. Centrally mounted within the housing is a chalk line reel which has stored thereupon, an elongated flexible chalk line which projects through the opening at one end of the housing. An arc scribing disk is mounted in the opening at the other end of the housing, so that a part of the disk projects through this opening and a part is within the housing. Chalk carrying felt pads are disposed on opposite sides of the opening in which the arc scribing disk is located so that as the disk is rotated about a supporting shaft, it continuously picks up chalk dust from the felt pads and is capable of marking or scribing an arc of a given radius when the free end of the chalk line which is extended through the opening in the other end of the housing is anchored.

An important object of the present invention is to provide a chalk line device which can be utilized in the conventional fashion for snapping a chalk line between two predetermined points, but which can also be used as a plumb bob for establishing a vertical line between two points, or as an arc scribing device for scribing arcs on substantially any flat surface, with the arcs being of a predetermined or selected radius.

A further object of the invention is to provide an improved chalk line device which is compact in construction and is susceptible to extended usage over long periods of time without malfunction.

Another object of the invention is to provide a versatile tool for use in construction where it is necessary to measure angles, mark out arcs of predetermined radii, establish a chalked line between two predetermined points or establish a vertical line between two vertically spaced points.

Additional objects and advantages of the invention will become apparent as the following detailed description of a preferred embodiment of the invention is read in conjunction with the accompanying drawings which illustrate such preferred embodiments.

GENERAL DESCRIPTION OF THE DRAWINGS

DETAILED DESCRIPTION OF A PREFERRED EMBODIMENT OF THE INVENTION

Figure 1:
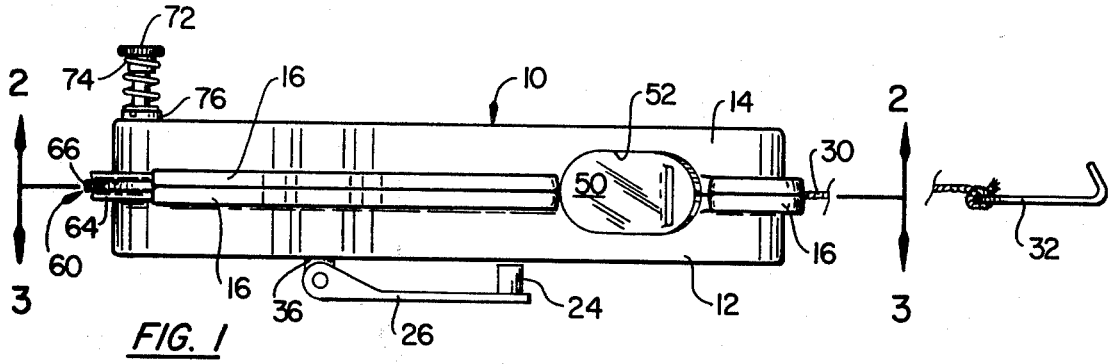
FIG. 1 is a side elevation view of the chalk line device of the invention as it appears when viewed from one side thereof.

Referring initially to FIG. 1 of the drawings, the chalk line device of the invention comprises a housing designated generally by reference numeral 10 which is formed by a pair of cooperating side plates 12 and 14. The side plates 12 and 14 each carry an edge flange 16, with the edge flanges of the side plates 12 and 14 abutting along the meeting side edges of the two plates to form a chalk dust seal. The housing 10 as made up by the cooperating side plates 12 and 14 thus forms a hollow enclosure. A hollow rivet 20, or other suitable fastening means, is extended through aligned openings 22 formed in each of the side plates 12 and 14 and is employed for holding the cooperating side plates in their inter-engaged housing-forming relationship. The hollow rivet 20 also provides, at one of its ends, an aperture for receiving a stud 24 carried at one end of a reel handle 26 in a manner and for a purpose hereinafter described.

Figure 3:
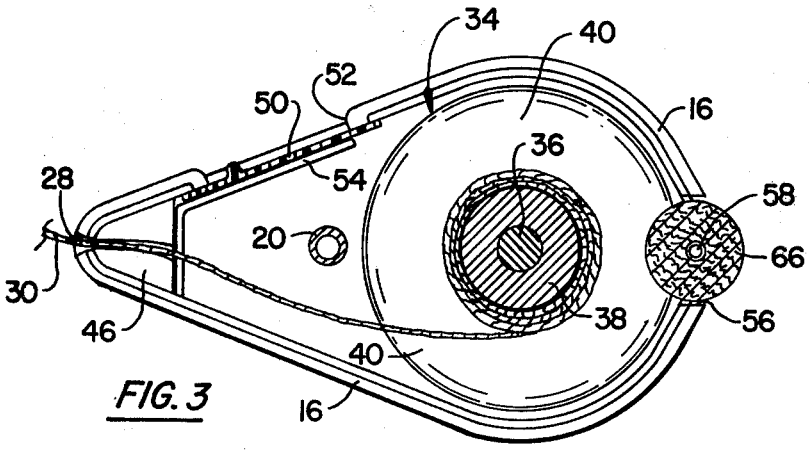
FIG. 3 is a sectional view taken along line 3—3 of FIG. 1.
Figure 4:
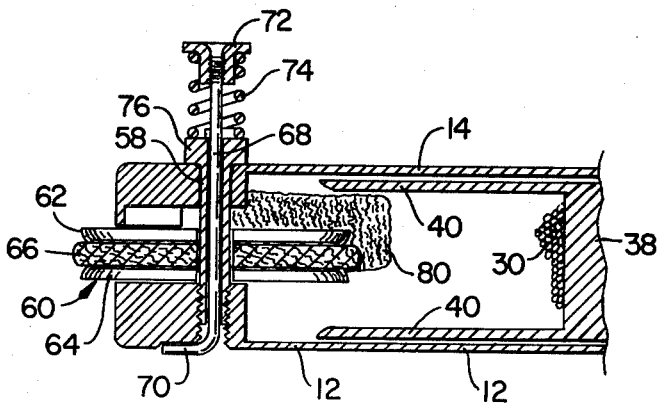
FIG. 4 is an enlarged sectional view of an end portion of the chalk line device of the invention.

The flanges 16 carried by the cooperating side plates 12 and 14 are interrupted or apertured adjacent one end of the housing 10 to provide an opening 28 through which a flexible string or line 30 is extended in the manner shown in FIG. 3. The chalk line 30 carries a ring or hook 32 at its free end outside the housing 10, which enables one end of the chalk line to be anchored or secured at a selected point from which a chalked line is to be snapped on a surface.

The chalk line 30 is reeled upon a reel structure, designated generally by reference numeral 34, which reel structure is mounted upon a shaft 36 for rotation within the housing 10. The reel structure 34 includes a central hub 38 which is keyed to the shaft 36, and which functions to carry contiguous convolutions or loops of the chalk line 30 between a pair of relatively large, disk-shaped end flanges 40 which are secured to opposite ends of the hub 38 and in concentric relation to the hub and shaft 36. The chamber defined by the cooperating side plates 12 and 14 carries, in addition to the reel structure 34, a body of chalk dust which is thus placed in contact with the chalk line 30 so as to permit chalk dust to be carried on this line as it passes from the housing 10 through the opening 28. There is also positioned within the housing 10 at that end of the housing at which the opening 28 is located, a pair of opposed, grooved solid chalk bodies 44 and 46 with the grooves provided in these bodies being aligned to form a channel 48 through which the chalk line 30 is extended.

Figure 2:
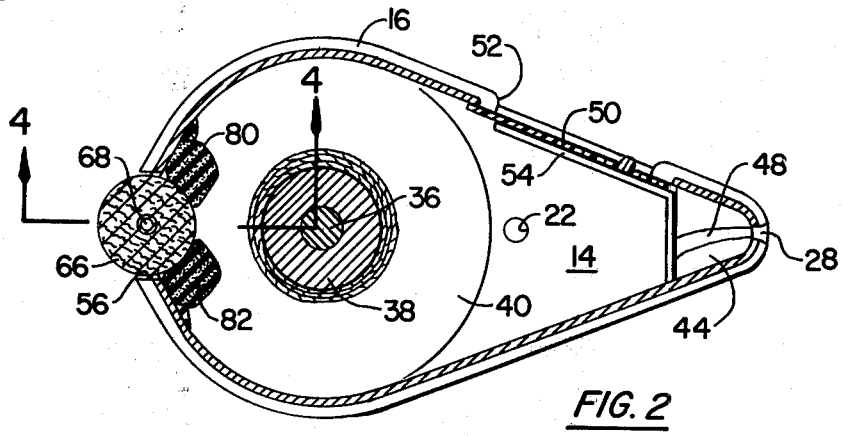
FIG. 2 is a sectional view taken along line 2—2 of FIG. 1.

In order to permit the housing 10 to be opened and replacement chalk dust to be added to the hollow interior thereof, a sliding closure plate 50 is mounted across an opening 52 formed by opposed recesses in each of the side walls 12 and 14 as shown in FIG. 1. The closure plate 50 slides upon a pair of opposed, substantially parallel ribs 54, with one of these ribs carried on each of the side plates 12 and 14. The closure plate 50 may be shifted from the position illustrated in FIGS. 1–3 to an open position in which the opening 52 opens into the interior of the housing 10, and thus enables the refilling of chalk dust to be accomplished.

For the purpose of paying out the chalk line 30 from the reel structure 34, the shaft 36 upon which the hub 38 is mounted is extended through the side wall 12 and is pivotally connected at its outer end to the reel handle 26. The reel handle 26 can be pivoted through 180° from the position shown in FIG. 1 to permit the handle 26 and the stud 24 to be utilized in rotating the reel assembly 34 so as to permit the chalk line 30 to be paid out. At such time as it may be desired to lock the reel structure 34 against rotation, the handle 26 is pivoted to the position shown in FIG. 1 and is then pushed inwardly toward the side wall 14 so as to engage the stud 24 with the open hollow end of the rivet 20. The reel structure then becomes locked against rotation and, if desired, the chalk line device of the invention can then be used as a plumb bob by securing the ring or anchoring element 32 to an overhead location, and permitting the lower end of the housing 10 to point toward a location directly vertically below the point of securement of the ring or anchoring element 32.

At the opposite end of the housing 10 from that at which the opening 28 is located, the flanges 16 carried by the side plates 12 and 14 are relieved, and a pair of cooperating recesses are provided in the side plates which together define an opening 56. The opening 56 communicates with the interior of the housing 10. Mounted within the opening 56 by the use of a shaft 58 extended between the side plates 12 and 14 is an arc-scribing disk assembly, designated generally by reference numeral 60. The arc-scribing disk assembly 60 includes a pair of opposed, substantially parallel steel washers 62 and 64 which sandwich between them a felt disk 66. It will be perceived that the diameter of the felt disk 66 slightly exceeds that of the washers 62 and 64 so that its outer peripheral edge is exposed for rolling contact with a surface when an arc is to be scribed by the use of the chalk line device. The shaft 58, hereinbefore described, is extended through the metallic plates 62 and 64 and the felt disk 66 and is threaded into an aperture formed in the side plate 12. A tensioning rod 68 having a turned-over toe 70 at one end thereof is projected through a bore formed axially through the shaft 58. The end of the tensioning rod 68 opposite the toe 70 is threaded for engagement with a threaded cap 72 which bears against one end of a compression spring 74. The opposite end of the compression spring 74 bears against a head 76 carried at the opposite end of the shaft 58 from its threaded end.

Mounted within the housing 10 on opposite sides of the opening 56, and secured to the side plate 14 are a pair of chalk retaining felt pads 80 and 82. The felt pads 80 and 82 are disposed at a location where they are in contact with the periphery of the disk assembly 60, and more specifically, the felt disk 66, as the felt disk and the metal plates 62 and 64 are rotated about the shaft 58. The felt pads 80 and 82 are also in contact with chalk dust which is in the housing chamber, since the dust is able to bypass the reel assembly 34 by passage about the outer periphery thereof.

OPERATION

In the use and operation of the chalk line device of the invention, the device can, of course, be utilized in the conventional fashion by releasing the reel structure 34 by disengagement of the stud 24 from the open outer end of the hollow rivet 20. By pulling outwardly on the anchoring device or ring 32, the chalk line 30 is pulled from the hub 38 of the reel structure, and may be extended between two preselected points. The ring or anchoring device 32 is secured at one of these points and the housing 10 is located at the other of the points. By then lifting up and snapping the taut chalk line 30 as it is extended between these points, a chalk line can be placed upon a surface in which the two points lie to form a straight line between the points.

When it is desired to use the chalk line device as a plumb bob, the reel is braked and stopped from rotation by placement of the stud 24 in the open end of the rivet 20 where it opens in the outer side of the side plate 12. With the reel structure 34 thus braked, the housing 10 may be suspended from the chalk line after the ring or anchoring device 32 has been secured to an overhead location from which it is desired to measure downwardly in a vertical line. If a point exactly below the point of securement of the ring or anchoring device is to be scribed on a horizontally extending surface, this can be accomplished by extending the housing 10 to a point where the felt disk 66 will barely touch such surface. At this time, the reel assembly 34 is braked or stopped off by placement of the stud 24 in the open end of the rivet 20, and the housing 10 is then simply permitted to swing as a pendulum. In undergoing such swinging movement, a point will be defined by the several places at which marks made by the felt disk 66 cross or intersect as the housing 10 swings back and forth in a pendulum movement. This point will be directly below the point at which the upper end of the chalk line is anchored.

When it is desired to use the chalk device of the invention for scribing arcs which have radii corresponding to the length of the chalk line 30, this is accomplished by anchoring or securing the ring 32 at a point which is to constitute the center of curvature of the arc, and then extending the housing 10 substantially normal to the direction of extension of the chalk line 30 at a location which corresponds to the radius of the arc to be scribed. With the device in this orientation, the felt disk 66 can then be used to scribe or mark a chalk arc upon a surface which extends substantially normal to the major plane of the housing 10, or stated differently, extends substantially parallel to the axis of rotation of the reel assembly 30. An arc of any size can be scribed in this fashion and, if desired, the radii of the arc can be snapped out at various locations (by the conventional use of the chalk line 30) upon the surface in which the arc is being scribed.

From the foregoing description of a preferred embodiment of the invention, it will be perceived that the chalk line device of the invention is highly useful for a number of purposes and constitutes a valuable tool to the carpentry and related trades. The device is relatively simple in its construction and is durable and long lived in its operating life. Although certain structural characteristics of the preferred embodiment have been herein described in order to illustrate the basic principles upon which the invention is based, it will be understood that various changes and innovations in the described and illustrated structure can be effected without departure from such basic principles. Changes and innovations of this type are therefore deemed to be circumscribed by the spirit and scope of the invention, except as the same may be necessarily limited by the appended claims or reasonable equivalents thereof.

What is claimed is:

1. A chalk line device comprising:
- a hollow housing having an opening at each of the opposite ends thereof;
- a chalk line reel inside the housing;
- a chalk line extending from the reel through the opening at one end of the housing; and
- an arc scribing disk assembly mounted in the opening at the other end of the housing and including a scribing disk having a part thereof inside the housing and a part thereof outside the housing.

2. A chalk line device as defined in claim 1 wherein said housing comprises a pair of cooperating side plates.

3. A chalk line device as defined in claim 2 wherein said device further includes a closure plate movably mounted in said housing for movement to open and close an opening in said housing.

4. A chalk line device as defined in claim 1 wherein said device further includes a closure plate movably mounted in said housing for movement to open and close an opening in said housing.

5. A chalk line device as defined in claim 1 and further characterized as including pad means mounted adjacent said arc scribing disk assembly for transferring chalk dust to said disk assembly.

6. A chalk line device as defined in claim 5 wherein said disk assembly comprises:
- a pair of metallic washers;
- a felt disk mounted between said washers; and
- shaft means extending across the hollow interior of said housing through said washers and felt disk for supporting said arc scribing disk assembly in said housing.

7. A chalk line device as defined in claim 6 wherein said device further includes a closure plate movably mounted in said housing for movement to open and close and opening in said housing.

8. A chalk line device as defined in claim 7 wherein said housing is of generally diamond-shaped configuration with said openings located in the pointed opposite ends thereof whereby said device is capable of use as a plumb bob.

9. A chalk line device as defined in claim 1 wherein said disk assembly comprises:
- a pair of metallic washers;
- a felt disk mounted between said washers; and
- shaft means extending across the hollow interior of said housing through said washers and felt disk for supporting said arc scribing disk assembly in said housing.

10. A chalk line device as defined in claim 1 and further characterized as including a solid body of chalk on opposite sides of said chalk line adjacent the opening through which said chalk line passes from said housing.

11. A chalk line device as defined in claim 1 wherein said housing is of generally diamond-shaped configuration with said openings located in the pointed opposite ends thereof whereby said device is capable of use as a plumb bob.

* * * * *